United States Patent [19]

Török et al.

[11] Patent Number: 5,024,685

[45] Date of Patent: Jun. 18, 1991

[54] ELECTROSTATIC AIR TREATMENT AND MOVEMENT SYSTEM

[75] Inventors: Vilmos Török, Lidingö ; Andrzej Loreth, Åkersberga, both of Sweden

[73] Assignee: Astra-Vent AB, Stockholm, Sweden

[21] Appl. No.: 377,855

[22] PCT Filed: Dec. 11, 1987

[86] PCT No.: PCT/SE87/00595

§ 371 Date: Jun. 19, 1989

§ 102(e) Date: Jun. 19, 1989

[87] PCT Pub. No.: WO88/04851

PCT Pub. Date: Jun. 30, 1988

[30] Foreign Application Priority Data

Dec. 19, 1986 [SE] Sweden ..... 8605475
May 11, 1987 [SE] Sweden ..... 8701916

[51] Int. Cl.[5] ..... B03C 3/00

[52] U.S. Cl. ..... 55/117; 55/131; 55/135; 55/151; 361/230

[58] Field of Search ..... 55/117, 128–131, 55/136–138, 150–153, 154, 155; 361/230

[56] References Cited

U.S. PATENT DOCUMENTS 1,399,441 12/1921 Peterson ..... 55/117
1,931,436 10/1933 Deutsch ..... 55/131
1,980,521 11/1934 Hahn ..... 55/128
2,142,129 1/1939 Hoss et al. ..... 55/131
2,871,974 2/1959 Werst ..... 55/137
4,133,652 1/1979 Ishikawa et al. ..... 55/138
4,244,710 1/1981 Burger ..... 55/131
4,904,283 2/1990 Hovis et al. ..... 55/131

FOREIGN PATENT DOCUMENTS 821900 9/1969 Canada ..... 55/131

*Primary Examiner*—Bernard Nozick
*Attorney, Agent, or Firm*—Browdy and Neimark

[57] ABSTRACT

An air treatment system which includes a wire-like corona electrode and an air permeable target electrode arranged concentrically around the corona electrode with the electrodes connected to a d.c. voltage source having a voltage causing a corona discharge at the corona electrode and an ion wind through the target electrode. The target electrode may have a substantially cylindrical configuration, in which case air flows axially into the target electrode through one or both of the open ends thereof and exits from the target electrode radially through its air permeable wall. The target electrode may also be divided into two or more separate parts arranged essentially concentrically around the corona electrode in mutually uniform spaced relationship.

17 Claims, 4 Drawing Sheets

ELECTROSTATIC AIR TREATMENT AND MOVEMENT SYSTEM

The present invention relates to an air transport system and preferably also to further treatment of the transported air, such as cleansing air from aerosol and/or gaseous impurities and/or heating or cooling the air, while using a so-called electric ion wind or corona wind as the actual air transporting medium.

It is known to transport air with the aid of a so-called electric ion-wind or corona-wind. A system constructed to this end will, in principle, comprise a corona electrode and a target electrode which are mutually spaced apart and each connected to a respective terminal or pole of a d.c. voltage source, wherein the configuration of the corona electrode, the mutual potential difference, and the distance between the corona electrode and the target electrode are such as to engender at the corona electrode a corona discharge which generates air ions. The air ions thus generated migrate rapidly to the target electrode under the influence of the electric field extending between the corona electrode and the target electrode, where they surrender their electrode charge. During their movement along this path, the ions collide with electrically neutral air molecules and transfer electrostatic forces thereto, such as to draw these air molecules towards the target electrode and therewith transporting air in the form of a so-called ion wind or corona wind. Air transporting systems of this kind are described and illustrated in International Patent Application PCT/SE 85/00538.

As will be seen from this international patent application, it is possible to achieve significant air flow velocities and air flow throughputs with the aid of such ion or corona winds. High efficiencies, however, are contingent on a large potential differences between corona electrode and target electrode, in order to be able to sustain a corona discharge when the corona electrode and the target electrode are spaced at a considerable distance apart. A large corona current, which per se promotes high air flow velocities and a high air throughput, has the drawback or resulting in an increase in the generation of chemical compounds, primarily ozone and oxides of nitrogen, in the vicinity of the corona electrode, which are recognized as serious irritants and even a health hazard for human beings. Consequently it is desirable to apply a moderate corona current and to space the corona electrode and the target widely apart. It will also be seen from the international patent application that it is necessary to screen carefully the corona electrode of these known systems, in order to prevent the air ions produced from wandering or migrating in directions other than towards the target electrode. Although it is desireable to achieve a high volumetric throughput, when a system of this kind is used not only for transporting air, i.e. purely as a fan, but also for treating the air being transported, i.e. to cleanse the air of contaminants carried thereby and/or to change the temperature of the air, there is not the same need to achieve high flow velocities of the air passing through the system. Low air flow velocities are actually preferred in this dual purpose use of such systems, since low velocities result in longer dwell times of the air in the vicinity of the air treatment devices incorporated in the system, and therewith in greater efficiency, without it being necessary to give said devices an exaggerated axial extension in the direction of the air flow. system constructions in which the target and corona electrodes are enclosed in an air flow duct in which the air treatment devices are located together with or downstream of the target electrode, which is the most natural and most obvious construction, have been found to have significant drawbacks. For example, it has been found very difficult to achieve uniform velocity distribution across the whole cross-section of the flow duct; non-uniform velocity distribution will detract from the efficiency of the air treatment devices. It is also difficult to prevent the air treatment devices from presenting significant resistance to the air flowing through the duct, which resistance requires an increase in the potential difference between corona electrode and target electrode in order to increase the corona current. This latter remedy, however, results in the serious drawback of higher ozone and NOX generation. Furthermore, the duct walls surrounding the electrode arrangement have a disturbing influence on the function of the corona electrode, such as to prevent the corona discharge and the corona current from developing in a desired, effective manner.

Consequently, an object of the present invention is to provide an improved air transporting and air treatment system of the aforesaid kind which will overcome at least most of the problems discussed above.

The characteristic features of a system according to this invention are set forth in the following claims.

The fundamental principle of the invention, together with conceivable and advantageous further developments thereof, will now be described with reference to a number of exemplifying embodiments of the invention and to the accompanying drawings, in which FIG. 1 illustrates schematically an axial section designated by section line 1—1 in FIG. 2 of a first embodiment of the present invention;

Figure 1:
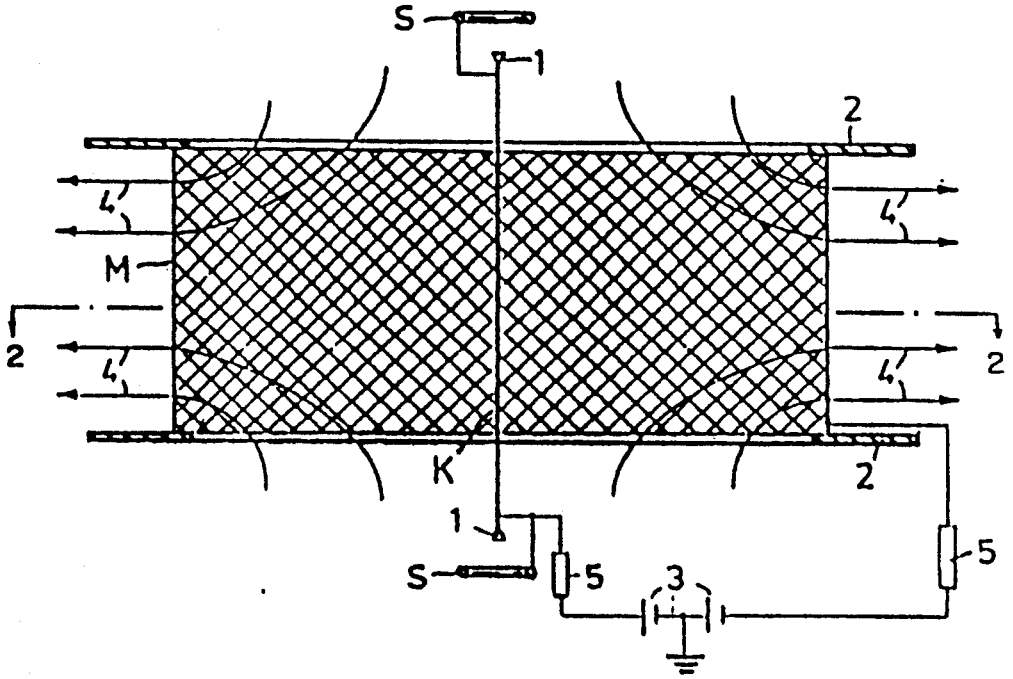
Figure 2:
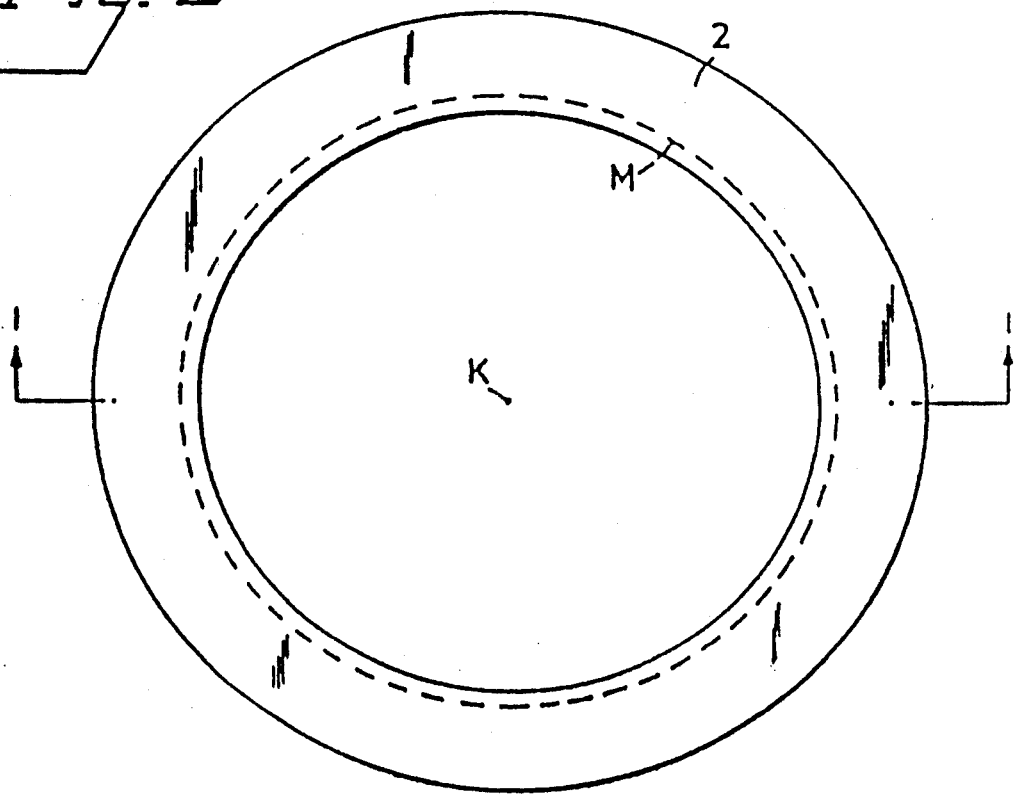
FIG. 2 illustrates schematically a radial section designed by section line 1—1 in FIG. 1 of that first embodiment of the present invention.

The inventive system illustrated schematically and by way of example in FIGS. 1 and 2 includes a corona electrode K which consists of a thin wire stretched between holders 1 of appropriate design, these holders being shown solely schematically. The system further includes a target electrode M which has a hollow cylindrical form and which encloses the corona electrode and extends co-axially therewith. In the case of the illustrated embodiment, the target electrode M consists of a wide-mesh network of electrically conductive or semi-conductive material and is held positioned between rings 2 of insulating material, e.g. plastic rings, said rings being supported in some suitable manner, not shown. The corona electrode K and the target electrode M are each connected to a respective terminal or pole of a d.c. voltage source 3, the voltage and the distance between the corona electrode and the target electrode, i.e. the diameter of the target electrode M, being so adapted that a corona discharge occurs at the corona electrode K. This corona discharge gives rise to ions which wander or migrate to the target electrode M under the influence of the electric field thus created, which in turn results in a flow of air towards the target electrode. The reader is referred to the aforesaid international patent application for a more detailed description of the events that take place in this regard. Consequently, in the case of the inventive system, there is engendered an air flow in the manner indicated with arrows 4 in FIG. 1, i.e. air flows in through the open axial ends of the hollow cylindrical target electrode M and flows essentially radially outwards through the air permeable wall thereof.

The illustrated electrode arrangement in which the target electrode M encircles the corona electrode K concentrically therewith affords several significant advantages. For example, with this arrangement the corona discharge occurs symmetrically around the whole of the corona electrode K, thereby enabling a significantly greater total corona current to be obtained, with unchanged potential difference and unchanged spacing between the corona electrode and the target electrode, than can be obtained with target and corona electrode arrangements described in the aforesaid international patent application. Alternatively, there can be used a small potential difference with an unchanged corona current. It will also be seen that the air flow will have a very low velocity in the immediate vicinity of the corona electrode K. This is highly beneficial, because it is then much easier to render harmless those deleterious gases generated by the corona discharge, e.g. such gases as ozone and oxides of nitrogen (NOX). This will be described in more detail hereinafter. Another highly important advantage afforded by the inventive system is that very large flow areas are provided, e.g. through the cylindrical target electrode M, which results in correspondingly low flow velocities. These low flow velocities afford significant benefit, since they enable the air to be treated effectively, e.g. enable the air to be cleansed efficiently from aerosol contaminants and/or gaseous contaminants, or to be cooled or heated, with the aid of appropriate devices located in the path of the air flow, preferably adjacent to or immediately and radially outside the hollow cylindrical target electrode M, or at the open ends of said electrode through which the air flows into the target electrode, or at both locations. Since the throughflow areas at these locations are large, the resistance offered by the air treatment devices will not be so significant. Furthermore, since the corona electrode is essentially surrounded totally by target electrodes, those effects which have been found highly disturbing with regard to the function of the corona electrode K when the corona electrode and target electrode are enclosed by a walled throughflow duct, the inner surfaces of the walls of which duct are electrically insulating while the outer surfaces thereof are conductive and earthed, will simply not occur.

It has been found that an advantage is afforded when the length of the corona electrode K is such that the electrode protrudes axially from both axially located ends of the target electrode M. When compared with an electrode arrangement in which the corona electrode K has the same axial length as the target electrode M, the longer target electrode enables the potential difference between corona electrode and target electrode to be reduced with the corona current unchanged, and also results in a greater total volumetric throughput of air through the system. The radial distance between the corona electrode K and the target electrode M of the inventive system is suitably greater than 5 cm and preferably greater than 8 cm. In the case of the system illustrated in FIGS. 1, 4 the radius of the target electrode M, i.e. the distance between the corona electrode K and the target electrode M, may be approximately equal to the axial height of the target electrode M. When the target electrode M has a radius of, e.g. 10 cm, the corona electrode K may extend, e.g., 3–4 cm beyond the axially located ends of the target electrode M.

As illustrated in FIG. 1, the corona electrode K and the target electrode M are advantageously connected to the voltage source 3 over high ohmic resistors 5, which in the event of a short circuiting of the corona electrode K or the target electrode M, e.g. as a result of being touched unintentionally, limit the short circuiting current to a completely safe value. This means that the system is not dangerous to touch. In order to prevent direct personal contact with the corona electrode or the target electrode, or to eliminate the possible occurrence of electrostatic fields from the system, protective grids can be provided externally of the open axially located ends of the target electrode M. These protective grids may be made, e.g., of a plastics material, or, when electrostatic screening is desired, of a semi-conductive or conductive material, in which latter case the protective grids are preferably earthed. These protective grids can be located at a distance of some centimeters, seen axially, from the ends of the corona electrode K and may be extended to the outer edge surfaces of the plastic rings 2. Undesirable flow of corona current to the protective grids can be prevented, by connecting the corona electrode K to a suitable positive or negative potential in relation to earth, while at the same time connecting the target electrode M to a potential of opposite polarity in relation to earth, this arrangement also greatly reducing the insulation problems which can be incurred by high potentials in relation to earth. In order to further prevent corona current from flowing from the corona electrode K in an undesirable direction, ring-shaped screening electrodes may be provided in axially spaced relationship with the ends of the corona electrode K, these screening electrodes being advantageously connected to the same potential as the corona electrode K. Such ring-shaped screening electrodes are illustrated schematically in FIG. 1 and referenced S therein.

The target electrode M of the inventive system illustrated by way of example in FIGS. 1 and 2 is assumed to consist of a wide-mesh network of electrically conductive or semi-conductive material. It should be noted in this connection that the current values received by the target electrode are extremely small and that the designation "electrically conductive or semi-conductive" with respect to the material from which the target electrode is made must be interpreted with regard hereto. Thus, the electrical conductivity of the material from which the target electrode is made may, in practice, be very low. It will also be understood that the target electrode M may have other configurations. For example, the target electrode may comprise axially extending rods arranged in mutually spaced relationship in a circle around the corona electrode K and concentrical therewith. Alternatively, plate electrode-elements or lamella-like electrode elements may be arranged to extend in axial and parallel relationship with the corona electrode K with the side surfaces of said elements extending radially, i.e. parallel with the radially directed air flow through the target electrode. The target electrode may also comprise a plurality of planar, ring-shaped electrode elements arranged concentrically in mutual axially spaced relationship around the corona electrode K. The target electrode may also have the form of a helically extending wire or lamella arranged concentrically around the corona electrode.

The aforementioned devices for treating the air may have different forms, these devices preferably being arranged adjacent the target electrode M or radially outwards thereof. For example, the air treatment devices may comprise a conventional mechanical filter for cleansing the air of aerosol contaminants, i.e. particles or liquid droplets, or a chemically active filter, e.g. incorporating active carbon, for removing gaseous contaminants from the air. Since the contaminant aerosols which accompany the air flow out through the target electrode M are electrically charged, as a result of the generation of ions caused by the corona discharge, the electrically charged contaminant aerosols may be extracted electrostatically from the air flow. To this end, there can be used, for example, an air permeable structure, e.g. in the form of thin lamellae of an electret material, located radially outside the target electrode M. Since the target electrode M has the opposite polarity to the electrically charged contaminant aerosols, the contaminants will tend to fasten to the target electrode, and hence the target electrode can be used advantageously as a precipitation surface for the contaminants in an electrostatic filter arrangement, e.g. an electrostatic capacitator separator. When it is desired to adjust the temperature of the air flow, i.e. to heat or to cool the air, a suitably constructed convector can be arranged radially outside the cylindrical target electrode.

FIGS. 3–6 illustrate schematically by way of example different possible configurations of the target electrode together with various conceivable devices for treating the air flowing therethrough.

Figure 3:
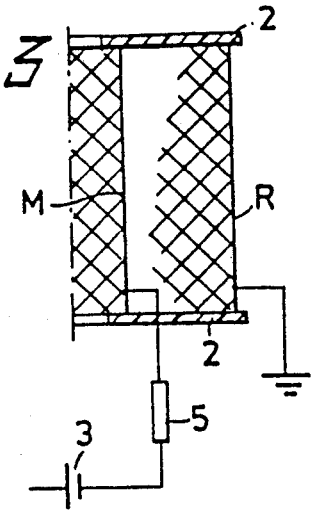
FIGS. 3, 4, 5 and 6 illustrate schematically, by way of example, various conceivable target electrode constructions, together with devices for treating air in a system constructed in accordance with the invention.

The target electrode M of the electrode arrangement illustrated in FIG. 3 has the configuration of the target electrode described in the aforegoing with reference to FIGS. 1, 2. In the FIG. 3 embodiment, the target electrode M has located radially thereof a further hollow cylindrical electrode R, which consists, e.g., of an open-mesh network of conductive or semi-conductive material and which is earthed and thus has an electrical potential which has the same polarity in relation to the polarity of the target electrode M as the corona electrode K. As beforementioned, the aerosol contaminants in the air, which have been charged electrically as a result of the aforesaid ion generation, strive to adhere to the target electrode M, which has the opposite electrical polarity to the electrically charged contaminants. Those contaminants which do not fasten immediately to the target electrode M, but which pass straight through instead, will be forced back towards the target electrode M by the influence exerted by the electric field generated between the target electrode M and the further electrode R, so as to positively adhere to the target electrode M. In this respect it is necessary that the force exerted on the charged contaminants by the electric field present between the two electrodes M and R is able to overcome the radially and outwardly directed air flow through the electrodes M and R. This can readily be achieved as a result of the low velocity of the throughflowing air. The electrode R can thus be considered to constitute a reflector electrode which reverses the direction of the charged contaminants and which thus effectively separates said contaminants from the air flow.

Figure 4:
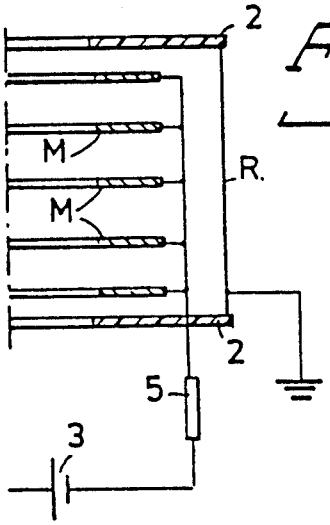

FIG. 4 illustrates a similar arrangement in which an earthed reflector electrode R is located radially outside the target electrode M, although in this case the target electrode comprises a plurality of ring-shaped, planar electrode elements which are arranged in mutual axially spaced relationship concentrically around the corona electrode. The electrode elements of the target electrode M will serve as electrostatic precipitation surfaces for aerosol contaminants in the air flow, similar to the aforedescribed case, wherewith the cleansing effect is enhanced due to the fact that the precipitation surfaces of the target electrode have substantial extension in the direction of the air flow, such as to prolong the dwell time of the charged contaminants in the vicinity of the precipitation surfaces and consequently have a greater possibility of migrating towards said surfaces.

Figure 5:
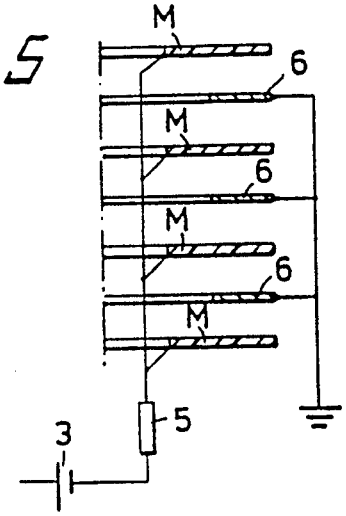

FIG. 5 illustrates an arrangement in which the target electrode M, similar to the FIG. 4 embodiment, comprises a plurality of planar ring-shaped electrode elements which are arranged in mutual axially spaced relationship concentrically around the corona electrode. In the case of the FIG. 5 embodiment the electrode elements of the target electrode M have arranged therebetween similar, planar ring-shaped electrode elements 6 which are connected to earth and which thus together with the electrode elements of the target electrode M form an electrostatic capacitor separator of a known kind. The electrically charged, aerosol contaminants present in the air migrate towards the target electrode M, under the influence of the electric field prevailing between the electrode elements of the target electrode M and electrode elements 6, and fasten to the electrode elements of said target electrode. As a result of the low velocity of the air flow, the dwell time of the contaminants between the electrode elements M and 6 is relatively long, which results in effective cleansing of the air.

Figure 6:
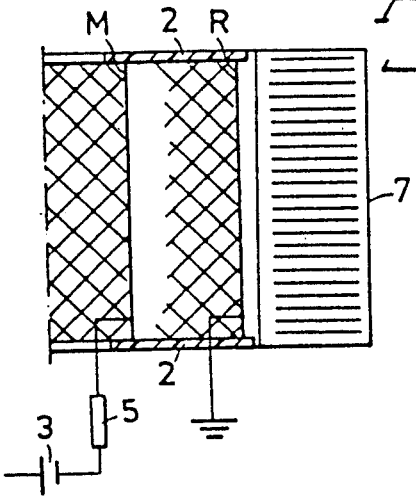

FIG. 6 illustrates an arrangement which is similar to the arrangement illustrated in FIG. 3. The FIG. 6 arrangement comprises a target electrode M and a reflector electrode R which is arranged radially outside the target electrode. The target electrode together with the reflector electrode form an electrostatic separator which is operative in extracting aerosol contaminants from the air flow in the manner described with reference to FIG. 3. The arrangement illustrated in FIG. 6 also incorporates a convector 7 of suitable configuration, which in the illustrated embodiment has the form of a cylinder which is placed radially outside the reflector electrode R such as to embrace the same. This convector 7 enables the temperature of the air flow to be changed, i.e. enables the air to be heated or cooled. Because of its large throughflow area and because of the low velocity of the air flow, the convector 7 obtains a very high efficiency and can be constructed in a manner which will ensure that it does not offer great resistance to the flow of air passing therethrough. Because the aerosol contaminants are extracted from the air effectively at the target electrode M, the convector 7 will remain clean and need not therefore be cleaned or exchanged. It will be necessary, however, to clean the target electrode M, or to change the electrode at uniform intervals. The convector 7 may also be constructed to form reflector electrodes itself, by connecting the connector electrically to earth. This obviates the need for the reflector electrode R.

Figure 12:
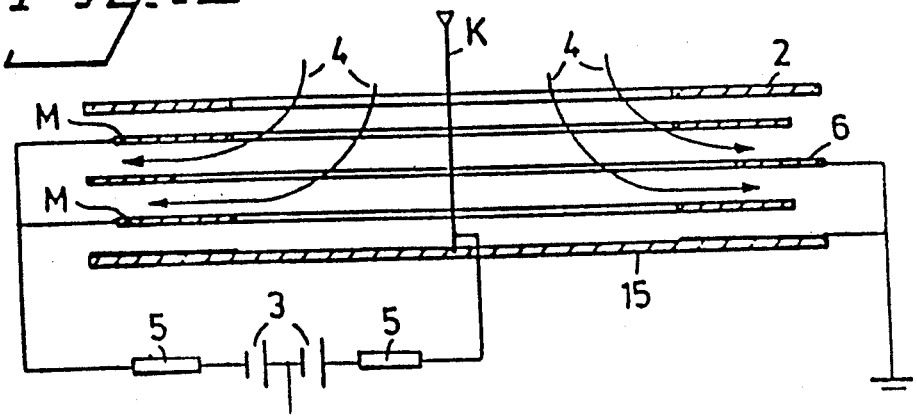
FIG. 12 illustrates schematically and in axial section a third embodiment of a system according to the invention.

Another interesting embodiment of a system constructed in accordance with the invention is illustrated schematically and in axial section in FIG. 12. This embodiment differs from the embodiment described above with reference to FIGS. 1, 2, in that one axially located end of the target electrode is closed by means of a planar, impervious plate 15, which thus replaces the plastic ring 2. The central part of the circular plate 15 preferably incorporate an insulating material which is used for attaching one end of the corona electrode K. At a radial distance from the central part of the circular plate, the plate 15 comprises an electrically conductive or semi-conductive material, or is provided with a coating of such material, which is preferably electrically earthed. The target electrode M of the FIG. 12 embodiment is constructed in a manner corresponding to that illustrated in FIG. 5, and a ring-shaped, electrically earthed electrode element 6 is also provided in a similar manner to the FIG. 5 embodiment. The air flow through the system illustrated in FIG. 12 will thus follow the path indicated by the arrows 4. With a system of this construction, the axial height of the target electrode M should be approximately half as great as the axial height of the target electrode of the system, or arrangement, illustrated in FIGS. 1, 2.

As beforementioned, the velocity of the air flow in the vicinity of the corona electrode K is very low when using a system constructed in accordance with the invention, which makes it easy to effectively remove and render harmless those deleterious or dangerous gases, primarily ozone and oxides of nitrogen, generated in conjunction with the corona discharge.

Figure 7:
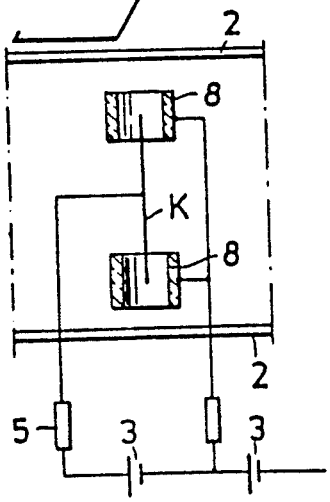
FIGS. 7, 8, 9, 10 and 15 illustrate schematically, by way of example, various conceivable arrangements adjacent the corona electrode of a system constructed in accordance with the invention, for the purpose of removing deleterious gases generated by a corona discharge.

This can be effected, for instance, with the aid of an arrangement illustrated in FIG. 7, in which a corona electrode K in the form of a wire is supported in a suitable manner (not shown) along the centre axis of the hollow cylindrical target electrode (not shown in FIG. 7). Attached to the ends of the corona electrode K are small sleeve-like elements 8 which comprise or incorporate a chemically active substance, for instance activated carbon, capable of absorbing or catalytically decomposing said deleterious gases, such as ozone and oxides of nitrogen. This can be achieved very effectively as a result of the negligible air flow in the immediate vicinity of the corona electrode K. As illustrated in FIG. 7, these chemically active absorbent elements 8 may be electrically connected to a somewhat lower potential than the corona electrode K, whereby the elements 8 will act as excitation electrodes or excitation elements which enable a corona discharge to be maintained at the corona electrode K with a reduced potential difference between the corona electrode and the target electrode.

Figure 15:
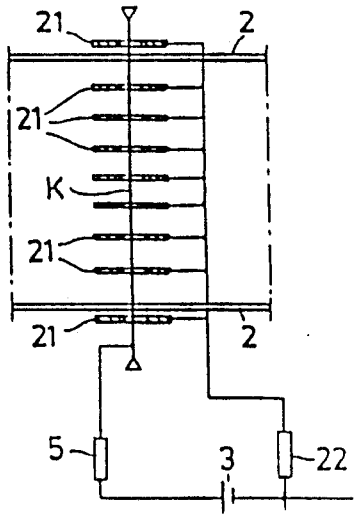

FIG. 15 illustrates schematically a further, similar arrangement for rendering harmless those deleterious gases generated in the vicinity of the corona electrode as a result of the corona discharge. In the case of this embodiment, the corona electrode K is surrounded concentrically by a plurality of mutually axially spaced ring-shaped plates 21 which comprise a chemically active substance, or which contain or are coated with a chemically active substance capable of absorbing or catalytically decomposing the deleterious gases generated by the corona discharge. Since the air flow in the vicinity of the corona electrode K is very small, the plates 21 are able to render said gases harmless in a very effective manner, these gases having no appreciable tendency to be carried away by an air flow. The air ions generated by the corona discharge are able to migrate freely to the surrounding target electrode (not shown in FIG. 15) between the ring-shaped plates 21. In order to prevent the plates 21 having a screening effect on the corona electrode K, and therewith interfere with the corona discharge, the plates 21 are preferably connected to earth over a very large resistance 22, so as to conduct away the electrical charges received by the plates 21. The plates 21 may comprise a conductive, semi-conductive or insulating material. It will be understood that other structures which comprise or contain chemically active substances capable of absorbing or catalytically decomposing the deleterious gases can be arranged around the corona electrode K, provided that the structures have a geometrical configuration which enables them to allow ions to pass through and provided that said structures are connected to an electrical potential such as not to screen the corona electrode.

Figure 8:
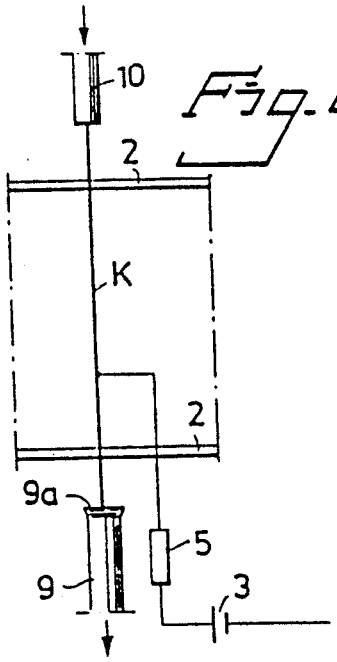

FIG. 8 illustrates schematically another arrangement for removing from the vicinity of the corona electrode K those deleterious or dangerous gases generated by the corona electrode. This arrangement comprises a tube 9 which is connected to an air suction device (not shown), for instance a fan or an air pump, and the inlet 9*a* of which is directed axially towards one end of the corona electrode K, so that the air layer containing said deleterious gases present around the corona electrode is continuously drawn through the tube 9 by suction. Since the air flow around the corona electrode K is very small, only a small quantity of gas need be drawn through the tube 9. The air drawn by suction through the tube 9, together with the accompanying deleterious gases, can be led to a device for cleansing the air of said gases, or can be discharged at some suitable location at which the gases in question do not constitute a hazard. As illustrated in FIG. 8, a tube 10 connected to a source of pressurized air (not shown) can be arranged at the opposite end of the corona electrode K, such as to direct a flow of air along the corona electrode K in a direction towards and into the suction tube 9. This renders the transportation of deleterious gases generated by the corona discharge still more effective. The tubes, or pipes, 9 and 10 may also serve as excitation electrodes, by ensuring that at least the ends of the tubes are electrically conductive and by connecting the same to a potential which is somewhat lower than the potential of the corona electrode.

Figure 9:
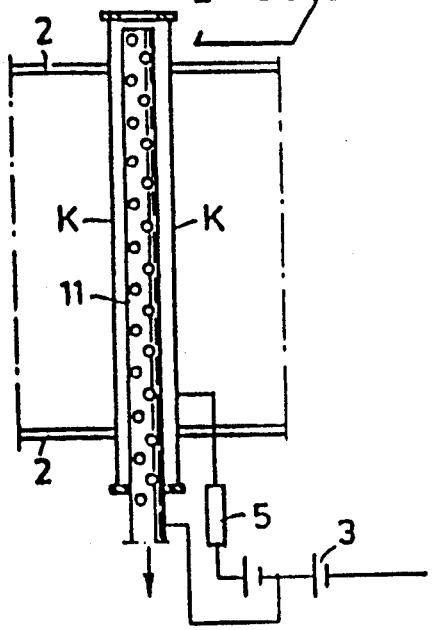

FIG. 9 illustrates schematically a further embodiment which is intended for a similar purpose and which includes a perforated tube 11 located along the centre axis of the hollow cylindrical target electrode. The perforated tube 11 is connected to a suitable air suction device (not shown) in a manner similar to the tube 9 of the FIG. 8 embodiment. In the case of the FIG. 9 embodiment, however, the end of the tube 11 is closed, so that air is sucked in solely through the perforations in the wall of the tube. In this case, the corona electrode consists of a plurality of wire-like electrode elements K which are arranged parallel with and around the tube 11, so that corona current is transmitted in all directions to the surrounding target electrode (not shown in FIG. 9). For the purpose of decreasing the requisite potential difference between the corona electrode and the target electrode, the tube 11 may also function as an excitation electrode for the corona electrode K in the manner previously described, by producing the tube 11 from an electrically conductive or semi-conductive material and connecting the tube to a potential which is somewhat lower than the potential of the corona electrode K.

Figure 10:
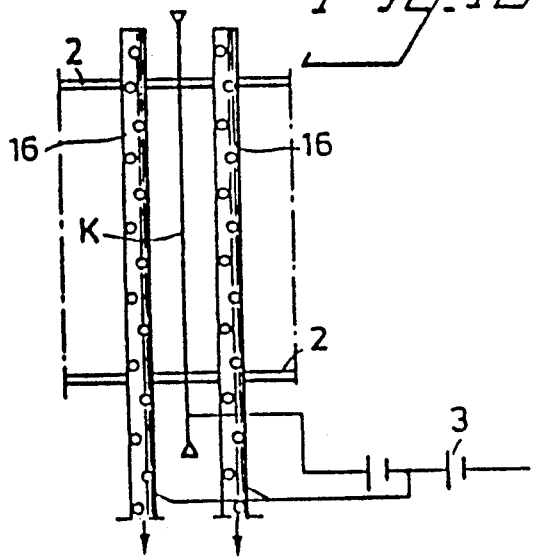

As illustrated schematically in FIG. 10, the reverse arrangement can be employed for removing ozone and oxides of nitrogen from the immediate vicinity of the corona electrode. In the FIG. 10 embodiment a plurality of perforated tubes 16, for instance three or four tubes, are arranged parallel with and around the corona electrode K, the tubes being connected to an air suction device such as to draw the air located in the immediate vicinity of the corona electrode K through the perforated walls of respective tubes 16. These tubes 16 may also advantageously function as excitation electrodes for the corona electrode K, by constructing the tubes from an electrically conductive or semi-conductive material and connecting the tubes to a potential which is somewhat lower than the potential of the corona electrode K.

Figure 11:
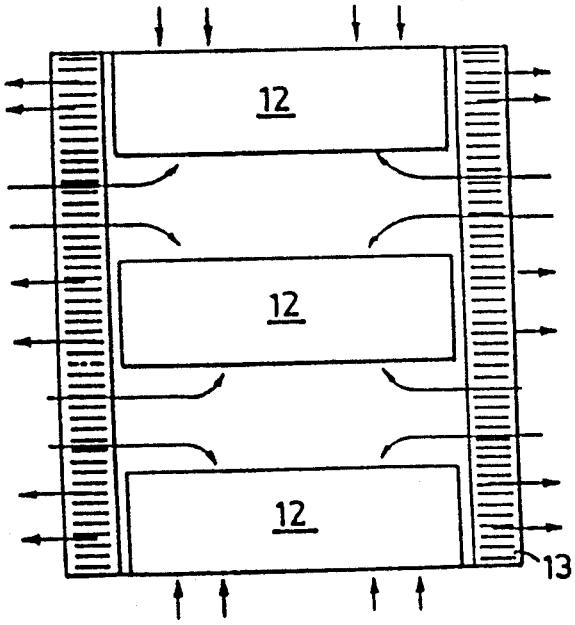
FIG. 11 illustrates schematically and in radial section a second embodiment of a system according to the invention.

As will be understood from the theoretical account rendered in the aforementioned international patent application, the distance between the corona electrode and target electrode, i.e. the diameter of the target electrode M of a system constructed in accordance with FIGS. 1, 2 is contingent on the potential difference between corona electrode and target electrode and on the desired value of the corona current. Thus, it is not possible to increase the total volumetric throughput of air with the aid of an arrangement constructed in accordance with FIGS. 1, 2 solely by increasing the dimensions of the arrangement and therewith also the diameter of the target electrode. An increased volumetric air throughput requires instead an arrangement of greater axial length. An extension of the axial length of the arrangement, however, would reduce the inlet areas at the axially located open ends of the cylindrical target electrode in relation to the outlet area through the permeable cylindrical surface of said electrode, therewith resulting in an increased resistance to flow and possibly also resulting in non-uniform distribution of the air flow through the target electrode. The arrangement illustrated schematically in FIG. 11 affords a suitable solution to this dilemma. This embodiment incorporates a plurality of air propelling units 12 each of which is constructed in accordance with the aforedescribed embodiment illustrated in FIGS. 1, 2. These units are arranged in axial, mutually spaced sequential relationship so as to leave between mutually adjacent units 12 a space through which air can flow into said units 12 in the manner indicated by arrows in FIG. 11. This embodiment of the inventive system may also incorporate an air treatment device, e.g. a cylindrical convector and/or chemical absorbent 13, which is arranged around the air propelling units 12 and also the spaces therebetween, so that both the inflowing air and the outflowing air will pass through the convector 14, or through some other air treatment device arranged in a similar manner.

Figure 13:
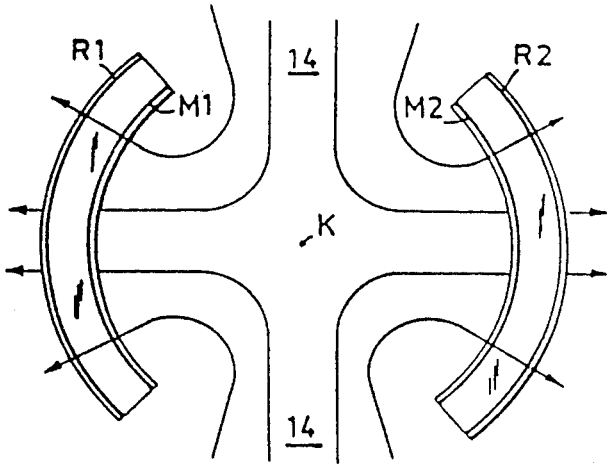
FIGS. 13 and 14 illustrate schematically and in radial section further embodiments of a system according to the invention.

FIG. 13 illustrates schematically and in radial section an alternative exemplifying embodiment of an inventive system which can be given a large axial extension in order to increase the total volumetric air throughput. The target electrode of this embodiment is divided into a plurality of arcuate electrode elements M1 and M2, which are two in number in the illustrated embodiment, located at a mutual peripheral distance apart around a cylindrical surface embracing the corona electrode K co-axially, such as to form a space 14 between the target electrode elements M1, M2. The air flows through the illustrated system in the directions shown by the arrows in FIG. 13, i.e. essentially radially through the spaces 14 between the target electrode elements M1, M2, and flows out essentially radially through said electrode elements. The flow area of respective spaces 14 is preferably equal to the flow area through the target electrode elements M1, M2.

In the case of an embodiment constructed in accordance with FIG. 13, in which two or more arcuate target electrodes are arranged concentrically around the central corona electrode, an advantage is afforded when the radius of curvature of the arcuate target electrodes is shorter than the radial distance to the corona electrode, i.e. such that the ends of respective arcuate electrodes lie at a shorter distance from the corona electrode than the central parts of said target electrode. This is illustrated schematically in FIG. 14. It has been found that this construction affords a more uniform distribution of the air flow through the whole area of the target electrodes.

Figure 14:
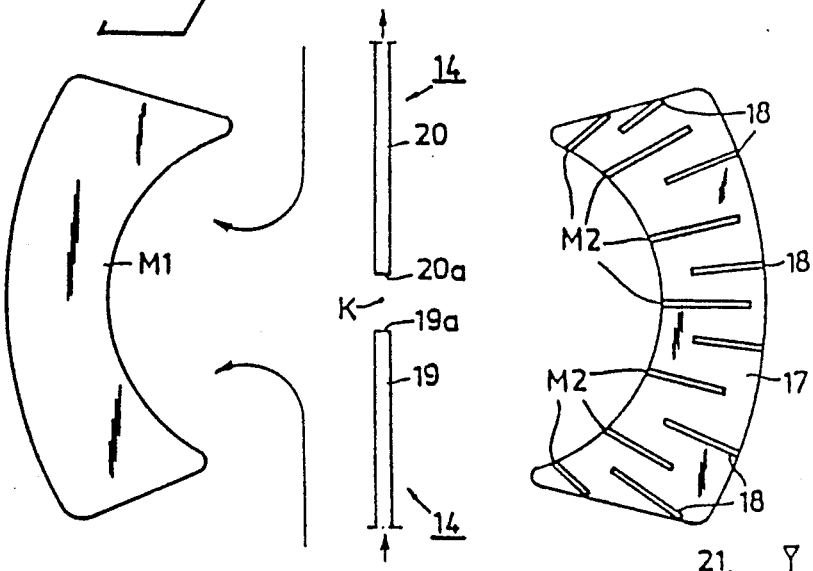

FIG. 14 also illustrates two different, conceivable embodiments of such arcuate target electrodes. The target electrode M1 shown on the left of said Figure comprises a plurality of plate-like electrode elements, or lamella-like electrode elements, arranged in mutually parallel relationship at right angles to the axial direction of the corona electrode K, in principally the same manner as that illustrated in FIG. 4. In the case of this embodiment, additional electrode elements, which are earthed and which correspond to the electrode element 6 of the FIG. 5 embodiment, may be arranged between the target electrode elements. The target electrode M2 shown on the right of FIG. 14 comprises a plurality of plate-like electrodes elements, or lamella-like electrode elements, which extend axially between insulating end plates 17, of which one is shown in the drawing, and which are oriented essentially radially in relation to the corona electrode K. The target electrode elements M2 have arranged therebetween plate-like or lamella-like electrode elements 18 which are arranged in a manner similar to the target electrode elements M2 but which are connected to earth. These electrode elements 18 have the same purpose as the electrode element 6 described in the aforegoing with reference to FIG. 5, and thus form a capacitor separator together with the target electrode elements M2. An advantage is afforded when these additional electrodes 18 are located at a slightly greater distance from the corona electrode K than the target electrode elements M2, so that no essential part of the corona current passes to the electrode elements 18.

Ozone and oxides of nitrogen can be removed very effectively from the immediate vicinity of the corona electrode K when using the embodiment illustrated in FIGS. 13 and 14, by blowing air over the corona electrode K from one side thereof through a slot-shaped conduit 19 connected to a source of pressurized air, while simultaneously withdrawing air by suction from the other side of the corona electrode K through a similar slot-shape conduit 20 connected to an air suction device. The conduits 19 and 20 thus have orifices 19*a* and 20*a* respectively which face towards the corona electrode K and which are slot-like in shape and extend substantially over the whole length of the corona electrode K in a direction perpendicular to the plane of the drawing. These conduits 19, 20 will not disturb the corona discharge at the corona electrode K to any appreciable extent and will not therefore appreciably change the requisite potential difference between the corona electrode and the target electrodes. The conduits 19 and 20 may also function as excitation electrodes for the corona electrode K, in the manner previously described, by making at least those parts of said conduits 19, 20 located nearest the corona electrode K electrically conductive or semi-conductive and connecting said parts to a potential which is somewhat lower than the potential of the corona electrode K.

A system which is constructed in accordance with the exemplifying embodiment of FIGS. 13 and 14 will provide substantially the same advantages as those obtained with a system constructed in accordance with the embodiment illustrated in FIGS. 1, 2 or in FIG. 12.

It will be appreciated that the number of arcuate target electrodes provided may be greater than two, for example three or four. It will also be appreciated that the target electrodes may, in other respects, be constructed in mutually different ways and combined with devices for treating the throughflowing air, as described in the aforegoing. For example, the target electrodes M1, M2 of the embodiment illustrated in FIG. 13 are combined with reflector electrode elements R1 and R2 respectively, as described with reference to the FIG. 3 embodiment. It will also be understood that air treatment devices may also be positioned in or adjacent to the spaces 14 which serve as air inflow openings. In the case of a system constructed in the manner illustrated schematically in FIGS. 13 or 14 it is preferred to close the axially located ends of the system, so as to prevent air from flowing in through said ends.

We claim:

1. A system for generating an air flow comprising
a corona electrode including an elongate thin wire;
a hollow substantially cylindrical target electrode structure having
two axial ends with at least one of said axial ends being open,
and an air permeable cylindrical wall structure;
said corona electrode wire extending along and substantially coinciding with a longitudinal axis of said cylindrical target electrode structure;
a direct current voltage source having
a first terminal connected to said corona electrode,
a second terminal connected to said target electrode structure,
a voltage difference between said first and second terminals of said voltage source to cause an air-ion generating corona discharge at said corona electrode generating an airflow under the influence of air-ions travelling from said corona electrode to said target electrode structure, said airflow entering through said open axial end and exiting through said air permeable cylindrical wall structure;
ring-shaped screening electrodes connected to said corona electrode in axially spaced relationship with ends of said corona electrode wire.

2. The system for generating an air flow according to claim 1 wherein
a heat exchanging means for changing temperature of said airflow is located radially outside of said cylindrical target electrode structure for treating said airflow exiting radially through said air permeable wall structure of said target electrode structure.

3. A system for generating an air flow comprising
a corona electrode including at least one elongate thin wire;
a hollow substantially cylindrical target electrode structure having
two axial ends with at least one of said axial ends being open,
and an air permeable cylindrical wall structure;
said corona electrode wire extending along and substantially coinciding with a longitudinal axis of said cylindrical target electrode structure;
a direct current voltage source having
a first terminal connected to said corona electrode,
a second terminal connected to said target electrode structure,
a voltage difference between said first and second terminals of said voltage source to cause an air-ion generating corona discharge at said corona electrode generating an airflow under the influence of air-ions travelling from said corona electrode to said target electrode structure, said airflow entering through said open axial end and exiting through said air permeable cylindrical wall structure;
means for separate removal of air from the immediate vicinity of said corona electrode and therewith of deleterious gaseous substances generated by the corona discharge, said means including
at least one tube having an end connected to air suction means,
and an opening in said at least one tube facing said at least one corona electrode wire.

4. The system for generating an air flow according to claim 3 wherein
said at least one tube includes a plurality of tubes whose opposite ends of said tubes from said end connected to an air suction means are closed and said openings in said tubes are perforations in said tubes facing at least one corona electrode wire;
said plurality of tubes arranged parallel to and around said at least one corona electrode wire.

5. The system for generating an air flow according to claim 3 wherein
said opening facing said at least one corona electrode wire is an opposite end of said tube extending axially towards and facing an end of said corona electrode wire.

6. The system for generating an air flow according to claim 5 wherein
said separate air removal means further includes
a second tube having one end connected to a source of pressurized air and an opposite open end directed axially towards and facing an opposite end of said corona electrode wire to direct flow of air along said corona electrode wire.

7. The system for generating an air flow according to claim 3 wherein
said opposite end of said tube having an end connected to an air suction means is closed;
and said opening in said tube are perforations in said tube facing said at least one corona electrode wire.

8. The system for generating an air flow according to claim 7 wherein said at least one corona electrode wire includes at least two corona electrode wires.

9. A system for generating an air flow comprising
a corona electrode including an elongate thin wire;
a target electrode structure having
at least two air permeable arc segments spaced from each other forming portions of a cylindrical surface with peripheral interspaces between said arc segments;
said corona electrode wire extending along and substantially coinciding with a longitudinal axis of said portions of a cylindrical surfaces of said target electrode structure;
a direct current voltage source having
a first terminal connected to said corona electrode,
a second terminal connected to said target electrode structure,
a voltage difference between said first and second terminals of said voltage source to cause an air-ion generating corona discharge at said corona electrode generating an airflow under the influence of air-ions travelling from said corona electrode to said target electrode structure, said airflow entering through said peripheral interspaces and exiting through said air permeable arc segments.

10. The system for generating an air flow according to claim 9 wherein
said at least two air permeable arc segments have a radius of curvature shorter than their radial distance to said corona electrode such that ends of said arc segments lie at a shorter distance from said corona electrode than centers of said arc segments.

11. A system as claimed in claim 9, wherein
said target electrode structure has an open axial end and a closed axial end;
and said corona electrode wire has a length exceeding the axial extension of said target electrode structure so that an end portion of said corona electrode wire projects through said open axial end of said target electrode structure.

12. The system for generating an air flow according to claim 9 wherein
said at least two air permeable arc segments are
a plurality of ring-shaped, planar electrode elements arranged in mutual axially spaced relationship concentrically around said corona electrode.

13. The system for generating an air flow according to claim 12 wherein
said at least two air permeable arc segments have a radius of curvature shorter than their radial distance to said corona electrode such that ends of said arc segments lie at a shorter distance from said corona electrode than centers of said arc segments.

14. A system for generating an air flow comprising
a cylindrical air permeable heat exchanging means for changing temperature of airflow through said heat exchanging means having two open axial ends and air permeable cylindrical walls;
a plurality of airflow generating means located along a longitudinal axis of said heat exchanging means;
said airflow generating means including
a corona electrode including an elongate thin wire;
an air permeable target electrode structure concentrically spaced from said corona electrode having two open axial ends;
said corona electrode wire extending along and substantially coinciding with a longitudinal axis of said cylindrical target electrode structure;
a direct current voltage source having
a first terminal connected to said corona electrode,
a second terminal connected to said target electrode structure,
a voltage difference between said first and second terminals of said voltage source to cause an air-ion generated corona discharge at said corona electrode generating an airflow under the influence of air-ions travelling from said corona electrode to said target electrode structure, said airflow entering through said open axial ends and exiting through said air permeable target electrode structure;
an airflow entering said heat exchanging means at said two open axial ends, and through said air permeable cylindrical walls at portions of said walls between said airflow generating means spaced from each other therein, and exiting through said air permeable cylindrical walls at portions of said walls adjacent to said air permeable target electrode structures emitting airflow therefrom from their respective airflow generating means.

15. A system as claimed in claim 14, wherein
said corona electrode wire has a length exceeding the axial extension of said target electrode structure so that end portions of said corona electrode wire are projecting through said opposite open axial ends of said target electrode structure.

16. A system for generating an air flow comprising
a corona electrode including an elongate thin wire;
an air permeable cylindrical target electrode structure concentrically spaced from said corona electrode having means for the airflow to exit therethrough and means for the airflow to enter said target electrode structure;
said corona electrode wire extending along and substantially coinciding with a longitudinal axis of said cylindrical target electrode structure;
chemically active means concentrically spaced from said corona electrode wire to chemically remove deleterious gases generated by a corona discharge at said corona electrode;
a direct current voltage source having
a first terminal connected to said corona electrode,
a second terminal connected to said target electrode structure,
a voltage difference between said first and second terminals of said voltage source to cause an air-ion generating corona discharge at said corona electrode generating an airflow under the influence of air-ions travelling from said corona electrode to said target electrode structure, said airflow entering through said air flow entering means and exiting through said air permeable target electrode structure;
said chemically active means including
sleeve-like elements incorporated chemically active absorbing material located at the ends of said corona electrode wire.

17. A system for generating an air flow comprising
a corona electrode including an elongate thin wire;
an air permeable cylindrical target electrode structure concentrically spaced from said corona electrode having means for the airflow to exit therethrough and means for the airflow to enter said target electrode structure;

said corona electrode wire extending along and substantially coinciding with a longitudinal axis of said cylindrical target electrode structure;

chemically active means concentrically spaced from said corona electrode wire to chemically remove deleterious gases generated by a corona discharge at said corona electrode;

a direct current voltage source having a first terminal connected to said corona electrode, a second terminal connected to said target electrode structure, a voltage difference between said first and second terminals of said voltage source to cause an air-ion generating corona discharge at said corona electrode generating an airflow under the influence of air-ions travelling from said corona electrode to said target electrode structure, said airflow entering through said air flow entering means and exiting through said air permeable target electrode structure;

said chemically active means including a plurality of mutually axially spaced ring-shaped plates surrounding concentrically said corona electrode and having a chemically active absorbing material on said plates.

* * * * *